United States Patent [19]

O'Brien et al.

[11] Patent Number: 4,481,973

[45] Date of Patent: Nov. 13, 1984

[54] DIFFERENTIAL PRESSURE ENERGIZED CIRCULATING VALVE

[75] Inventors: Thomas B. O'Brien; Edwin W. Thomas, both of Midland, Tex.

[73] Assignee: O'Brien Goins Engineering, Inc., Midland, Tex.

[21] Appl. No.: 462,666

[22] Filed: Jan. 31, 1983

[51] Int. Cl.[3] ..... F16K 17/20

[52] U.S. Cl. ..... 137/469; 137/508

[58] Field of Search ..... 137/469, 508

[56] References Cited

U.S. PATENT DOCUMENTS

| | | | |
|---|---|---|---|
| 2,069,645 | 2/1937 | Cardew | 137/469 |
| 2,855,952 | 10/1958 | Tausch | 137/508 |
| 2,920,764 | 1/1960 | Hodges | 137/508 X |
| 3,054,420 | 9/1962 | Williams | 137/469 |
| 3,199,532 | 8/1965 | Trick | 139/469 |
| 3,504,697 | 4/1970 | Colgan | 137/469 |
| 4,142,549 | 3/1979 | Autry | 137/469 |

*Primary Examiner*—Harold W. Weakley

*Attorney, Agent, or Firm*—Gunn, Lee & Jackson

[57] ABSTRACT

A circulating valve is provided for connection into the tubing string of a well for establishing selective flow of fluid between the tubing string and the well casing. The circulating valve incorporates a valve body which is adapted for connection into the tubing string of the well, which body defines a flow passage in registry with the flow passage of the tubing string. A valve seat is provided on the valve body and an outlet opening is defined downstream of the valve seat which is of sufficiently restricted dimension to permit opening of the valve at a particular injection pressure and to permit maintenance of the valve open condition by means of a pressure lower than the valve opening injection pressure.

26 Claims, 12 Drawing Figures

DIFFERENTIAL PRESSURE ENERGIZED CIRCULATING VALVE

FIELD OF THE INVENTION

This invention relates generally to circulating valves which control circulation of fluid between the casing and production tubing of a well to thus permit selective fluid treatment of the well. More specifically, the present invention concerns the provision of a circulating valve which is of differential pressure energized nature and which is capable of being opened at a particular injection pressure and maintained open at a pressure that is much lower than the particular injection pressure required to open the valve.

BACKGROUND OF THE INVENTION

Wells for the production of petroleum products are drilled to a production zone with the well bore being lined with large diameter pipe, typically referred to in the industry as well casing. The well casing is perforated at the production zone to establish communication between the production zone and the well casing. During well completion operations, production tubing is placed in the well casing, there being one tubing string for each production zone intersected by the well bore. Packers are sometimes set in the casing to form a seal between the tubing and casing immediately above the level of the production zone although in pumping type wells packers are seldom used unless for control of specific problems such as water leaks in the casing, dual completions, etc. In some cases, the zone is produced by the pressure of natural gas contained within the production zone. In other cases, the production zone is produced by means of pumping or by means of gas lift operations.

Where the fluid produced from the production zone contains a substantial quantity of paraffin, the paraffin tends to become deposited on the inner surface of the tubing and in time will build up sufficient thickness to restrict the flow of fluid through the tubing. It is then necessary to remove the paraffin from the tubing in order that the well may be placed back into efficient production. One method for paraffin removal is through the use of hot liquid such as hot water or hot oil having a temperature that is elevated above the melting temperature of the paraffin. Hot oil is circulated through the tubing string to melt the paraffin and transport it to the surface where it is recovered. To accomplish circulation of liquid through the tubing string it is desirable to establish fluid communication between the tubing string and the annulus between the tubing string and casing and to inject the hot water or hot oil either into the casing or tubing. The hot liquid is then allowed to pass down the casing as tubing for a sufficient period to accomplish efficient removal of the melted paraffin.

As shown by U.S. Pat. No. 4,049,057, hot liquid may be injected into the annulus to induce flow of liquid from the annulus into the tubing. Thus, the liquid flows upwardly through the tubing to the surface and carries melted paraffin along with it. In this case, the well casing remains free from any contamination by the paraffin. Alternatively, the hot liquid may be injected into the tubing string to dissolve the paraffin and the hot oil and melted paraffin will then flow upwardly through the annulus between the tubing string and casing to the surface. A pressure differential circulating valve of this nature is set forth in U.S. Pat. No. 4,257,484. Similar valves function as balance valves as taught by U.S. Pat. No. 2,211,846. In some cases, the differential valves incorporate external sleeves as taught by U.S. Pat. Nos. 3,542,130 and 4,257,484 or internal sleeve valves as taught by U.S. Pat. No. 3,500,911. In most cases circulation valves are operated by differential pressure, but in some cases, as taught by U.S. Pat. No. 3,376,936, a sleeve valve may be operated from the surface by means of surface control equipment. Other U.S. patents of interest to this subject matter include U.S. Pat. Nos. 2,128,352; 2,488,649; 2,855,952; 3,542,130 and 3,750,749.

In view of the fact that pressure differential type circulating valves are often located beneath the surface of liquid standing in the annulus of the well, the valve must be designed for efficient operation even when subjected to hydrostatic pressure which might act to inhibit opening of the valve. It is also desirable that a pressure differential type circulating valve incorporate pressure responsive means to ensure that the valve open at a designed injection pressure and that it be caused to remain open at a much lower injection pressure, thus ensuring efficient circulation of liquid between the well casing and tubing.

Another typical problem with differential type circulation valves is the unusually high injection pressure that is required in order to accomplish valve opening and circulation. For example, it is not unusual for hot water or hot oil to be injected into a well for paraffin treatment at a pressure range of 2000 PSI to 2500 PSI or higher. Obviously, with liquid standing in the well, a portion of the tubing string and casing will be subjected to hydrostatic pressure of the liquid. The injection pressure during hot liquid treatment will simply be added to the hydrostatic pressure for determination of the total pressure to which the tubing string and casing are subjected. Obviously, pressure of this character can be detrimental to the service life of standing valves and it can also overstress the tubing and casing to such extent that repair or replacement will be nessssary within a reasonably short period of time. It is desirable, therefore, to provide for hot liquid treatment of paraffin coated tubing at injection pressures that are materially reduced in comparison to high pressure circulating valves.

SUMMARY OF THE INVENTION

The present invention is directed to the provision of a differential pressure energized circulating valve which is adapted to be interconnected into the tubing string of the well. The valve mechanism incorporates a body structure that generally forms a straight-through flow passage of substantially the same internal diameter as the internal diameter of the tubing sections above and below the circulating valve. Annular seat means is provided by the valve body structure which may be located either externally or internally of the body structure as desired. A sleeve valve element is movably supported relative to the valve body structure and is urged toward the seat means by a compression spring, thereby inducing closure of the valve mechanism in the absence of differential pressure of sufficient pressure to open the valve. The valve element and seat are of such design that in a closed position of the valve, a small area of the valve element is acted upon by injection pressure. After the valve element has opened, a much larger area of the valve element is then acted upon by injection pressure, thereby allowing the valve to remain open at a much lower injection pressure than is required to induce initial opening movement of the valve. The valve and valve body mechanism cooperate to define one or more outlet openings which are located downstream of the seat means and are of sufficiently restricted dimension to permit maintenance of a particular pressure level within the valve body which acts upon the valve element after valve opening has occurred and maintains the valve in its open condition at a lower pressure than is required to accomplish opening of the valve.

The valve element is maintained in its closed condition by a spring force acting thereon, which spring force is of sufficient magnitude to overcome any pressure induced force acting on the valve under normal operating pressure. To accomplish opening of the valve, it is necessary that injection pressure be introduced either into the casing or into the tubing, depending upon valve construction, to thereby develop a pressure induced force acting on the valve which exceeds the spring force. When this occurs, the valve element will become unseated. As soon as the valve unseats from the seat surface, a much larger surface area of the valve element will be exposed to injection pressure. Unseating of the valve will also allow the flow of circulating fluid between the casing and tubing through a restricted orifice which is defined either by the valve or the valve body. The restricted orifice prevents injection pressure from dissipating rapidly and thereby also permits controlled maintenance of injection pressure on the valve element. Since a much larger area of the valve element is exposed to injection pressure after having been opened, it will remain open at a pressure much lower than the pressure required to open the valve. Such automatic opening will as well prevent the development of excessive and damaging pressure to surface flowlines and equipment, due to the automatic opening in response to such pressures. The valve will not normally move to the closed position when injection pressure is decreased or terminated. It will remain open until such time as the liquid remaining above the valve drains through the downstream outlet passages and falls to such a level that the hydrostatic pressure acting on the entire enlarged pressure responsive area decreases to such a point that will allow the spring compression force to overcome such force.

Accordingly, it is a primary feature of the present invention to provide a novel differential pressure energized circulating valve for hot liquid paraffin treatment, chemical treatment and the like which may be efficiently opened under pressure above the production pressure level of the well and which may be efficiently maintained open at a pressure much lower than the opening pressure of the valve mechanism.

It is also a feature of the present invention to provide a novel differential pressure energized circulating valve which is not restricted to any particular well depth and which may be efficiently operated by means of low pressure pumping equipment at the well head.

It is an even further feature of this invention to provide a novel differential pressure energized circulating valve having a sleeve valve which reciprocates between open and closed positions and which cooperates with the valve seat to define first and second pressure responsive areas thereof, the first pressure responsive area being responsive to injection pressure to open the valve and second pressure responsive area increasing the total pressure responsive area of the valve after opening thereof, thus ensuring maintenance of the valve open position at a pressure lower than valve opening pressure.

It is an even further feature of this invention to provide a novel differential pressure energized circulating valve having a straight-through flow passage in registry with the flow passages of the tubing to thereby permit passage of tools, subsurface pump and pump rods through the valve mechanism to therefore provide for servicing of well equipment located below the circulating valve.

It is another feature of this invention to provide a novel circulating valve mechanism which is pressure energized and which may be set at any suitable opening pressure simply by accomplishing adjustment of a compression spring system which urges the valve element toward the closed position thereof.

Among the several features of this invention is contemplated the provision of a novel differential pressure energized circulating valve which will open automatically in response to the development of excessive pressure either in the casing or tubing string to thus prevent the development of sufficient pressure differential in the well to cause damage to the tubing string.

It is another feature of this invention to provide a novel differential pressure energized circulating valve which is capable of automatically moving to the closed position thereof upon predetermined decrease of injection pressure to thereby return the tubing string to its production characteristics.

Other and further features and objects of the present invention will become evident to one skilled in the art upon a review of the preferred embodiment set forth in the following detailed description.

BRIEF DESCRIPTON OF THE DRAWINGS

These, together with other objects and advantages which will become subsequently apparent, reside in the details of construction and operation as more fully hereinafter described and claimed, reference being had to the accompanying drawings forming a part hereof, wherein like numerals refer to like parts throughout, and in which:

DETAILED DESCRIPTION OF PREFERRED EMBODIMENT

Figure 1:
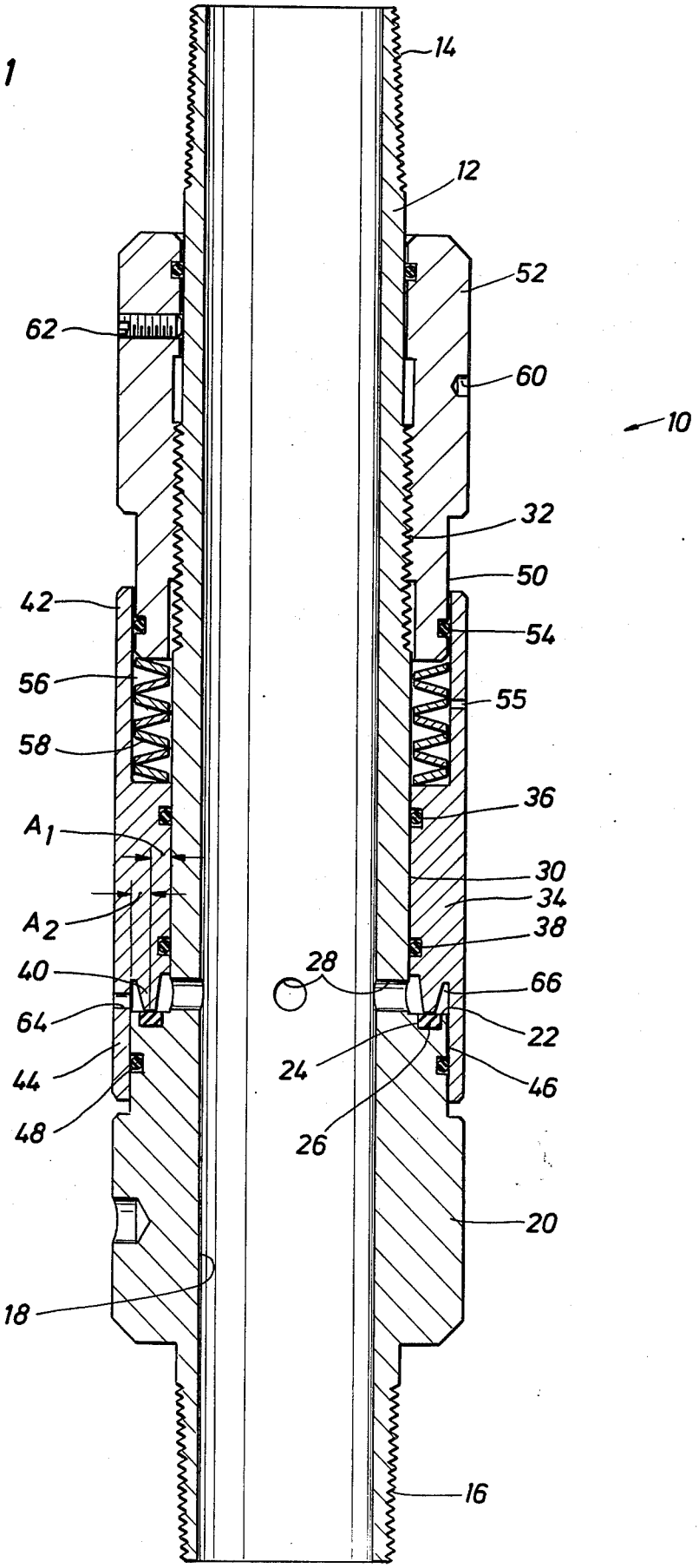
FIG. 1 is a sectional view of a differential pressure energized circulating valve constructed in accordance with the present invention.

Referring now to the drawings and first to FIG. 1, a differential pressure energized circulating valve is illustrated generally at 10 which incorporates an elongated generally tubular body structure 12 having upper and lower threaded extremities 14 and 16 which adapt the body structure for threaded connection to sections of tubing forming the tubing string of a well for production of petroleum products. The tubular body 12 defines an internal flow passage 18 which is of the same size and is coextensive with the internal diameters of the tubing sections located above and below the valve mechanism. The tubular body 12 incorporates an enlarged annular body portion 20 forming an upwardly directed seat shoulder 22 within which is formed a seat recess 24 receiving a seat member 26 of circular form.

Immediately adjacent the seat member 26 the valve body 12 is formed to define a plurality of inlet openings 28 through which injected fluid is allowed to flow from the flow passage 18 when the valve mechanism is in its open condition.

Intermediate the extremities of the tubular body 12, a cylindrical sealing surface 30 is formed and at one extremity of the sealing surface 30, the tubular body defines an externally threaded portion 32. A sleeve valve member 34 is disposed in close fitting relation about the cylindrical sealing surface 30 and is sealed with respect to the sealing surface by means of sealing elements 36 and 38 which may conveniently take the form of elastomeric O-rings or any other suitable circular sealing elements. If desired to prevent hydraulic siezing, a single O-ring seal may be employed in place of the spaced seals 36 and 38. The sleeve valve member 34 is capable of linear movement relative to the tubular body 12 during opening and closing movement thereof. The sleeve valve member 34 defines an annular sealing rim 40 which is adapted to establish sealing engagement with the circular seat member 26 in the closed position of the valve. The sleeve valve member also defines circular sealing skirts 42 and 44 at the upper and lower extremities thereof. Skirt 42 defines an equalizing port 43 preventing hydraulic interference with valve movement. The lower seat skirt 44 is adapted for positioning in closely spaced relation with an external cylindrical surface 46 of the tubular body and is sealed with respect to surface 46 by means of an annular sealing element 48 such as an elastomeric O-ring or the like. The upper sealing skirt 42 of the sleeve valve is disposed in closely spaced relation about an external cylindrical surface 50 which is defined at the lower extremity of a spring and valve retainer and adjustment element 52. An annular sealing element such as an elastomeric O-ring or the like establishes a seal between the lower cylindrical portion of the retainer 52 and the inner surface of the circular sealing skirt 42.

The sleeve valve element 34 and the retainer element 52 cooperate to define a spring chamber 56 within which is located a compression spring package 58. The spring package 58 may be formed of Bellville spring washers in the manner shown in FIG. 1 or, in the alternative, it may conveniently take the form of a helical compression spring or any other suitable spring member. The spring force applied by the spring package to the sleeve valve element 34 is adjustable by relative positioning of the retainer member 52 on the tubular body 12. An equalizing port 55 prevents hydraulic interference with valve movement. As shown, the retainer member is formed to define one or more spanner receptacles 60 enabling the retainer member to be rotated about the threaded portion 32 by means of a spanner wrench. As the retainer member is rotated and driven downwardly as shown in FIG. 1, the spring package 58 will be compressed thereby adding to the force of the spring package against the sleeve valve. After the retainer member 52 has been properly positioned on the tubular body to maintain the sleeve valve 34 under a desired spring force, the retainer may be locked in place by tightening one or more set screws 62.

An important advantage of the present valve mechanism as compared to other differential pressure energized circulation valves is that it has the capability of being opened under a conventional opening pressure and is also capable of being maintained open at a pressure that is much lower than the required opening pressure therefor. This feature effectively ensures against the typical requirement that expensive high pressure, high volume pumping equipment be provided at the site of the well. Since the valve mechanism of this invention may be opened at a reasonable pressure and operated at a much lower pressure as compared to other circulating valves, low cost, low pressure pumping equipment will effectively suffice for fluid injection operations. For example, in one differential pressure circulating valve being marketed at the present time, the surface pumping pressure for operation is in the order to 2000 PSI. Moreover, the valve mechanism is opened at a much lower pressure than is required for operation of it. When the valve mechanism is opened, the pressure drop that occurs upon unseating of the valve is of such magnitude that the valve mechanism tends to automatically close. To maintain the valve mechanism in its open, operating condition, surface pumping pressure must be increased to a pressure range of about 2000 PSI. This high pressure acts upon the tubing and also acts upon the standing valve at the bottom of the well. Moreover, this pumping pressure is added to any hydrostatic pressure that may be in the well, thereby possibly raising the pressure conditions to a dangerously high level. These problems are effectively overcome with the present invention.

As mentioned above, the tubular body structure 12 is formed to define a plurality of inlet openings 28 in the immediate vicinity of the seat member 26. These inlet openings simply provide fluid communication from the flow passage 18 to the valve seat 26. The fluid from the flow passage 18 will act against an inner annular surface area A1 which is defined by annular sealing contact between the sealing rim 40 and the seat member 26. In order to accomplish opening of the valve, the pressure communicated to the seat 26 must be of sufficiently high magnitude to act upon circular area A1 of the sleeve valve 34 and thus provide an upwardly directed pressure induced force that is sufficient to overcome the mechanical force applied downwardly on the sleeve valve by the spring package 58. When this occurs, the sleeve valve 34 will become unseated and will be urged upwardly against the spring force by means of the overbalancing pressure induced force acting on the sleeve valve. As soon as the valve member opens, however, another valve area A2 will be exposed to injection pressure from the tubing. Under this condition, the tubing pressure will act upon combined valve areas A1 and A2. Valve area A2 may be two or three times as great as valve area A1, thereby in essence multiplying the exposed valve area that is subjected to injection pressure. Upon communication of pressure to combined valve areas A1 and A2, a much greater pressure induced force will be developed, thereby causing the sleeve valve element 34 to shift rapidly to its maximum open condition. Thereafter, the injection pressure within the tubing may be substantially decreased without decreasing the upwardly directed pressure induced force on the sleeve valve sufficiently to allow spring closure of it so long as the rate of flow of the injected fluid is such as to maintain the pressure necessary to maintain the sleeve valve in the open position against the mechanically induced spring force.

Although the tubular body 12 is provided with a plurality of apertures 28 communicating pressurized fluid from the flow passage 18 to the valve seat, the discharge of fluid into the annulus from the sleeve valve is of restricted nature. As shown in FIG. 1, the lower skirt portion 44 of the sleeve valve is formed to define a single discharge aperture 64 through which the pressurized fluid medium is allowed to flow into the annulus of the well. It is not necessary, however, that only one discharge port or orifice be provided, it being necessary only that the discharge orifice or orifices define a restriction in comparison to the inlet ports or orifices 28. When the valve 34 opens this restriction permits fluid from the flow passage to be maintained in the seat/-valve chamber 66 at a pressure which is only slightly lower than the pressure within the flow passage. This pressure, acting upon the combined surface areas A1 and A2, provides sufficient pressure induced force to overcome the compression of the spring package 58. By restricting the discharge port 64, the sleeve valve 34 will be capable of being maintained at its open position at less pressure as compared to the pressure required for initial valve opening. This feature permits the pressure during fluid injection into the annulus to be maintained at a lower valve opening pressure as compared to convention circulating valves and, after valve opening, to be further lowered, rather than increased, a feature which represents an advantage over other known types of circulating valves.

The primary principle by which the circulating valve mechanism of this invention functions is the utilization of injection pressure, whether injected from the tubing or annulus, for the purpose of maintaining the equalizing valve in its open condition after having been opened. By providing a restriction at the discharge side of the valve in comparison to the dimension of the inlet to the valve, the valve may be maintained in its open condition at a much lower pressure than would be the case if the outlet or discharge port of the valve has a cross-sectional area equal to or greater than the dimension of the inlet. For example, in a circulating valve having particular design characteristics including a discharge port dimension of 0.25 inches and a pressure responsive valve area of 1.57 inches, the valve element may be maintained at its open position at a pressure in the order of 400 PSI. In similar valves of other manufacturers, injection pressure in the order of 1800 PSI may be required to maintain a valve of similar size in its open position. Since the operating pressure of the valve mechanism of this invention is quite low in comparison to that of other circulating valves, obviously the tubing and casing of the well is much less likely to become damaged by excessive pressure. Further, the standing valve of the well will not have any tendency to be damaged by excessive pressure.

Figure 2A:
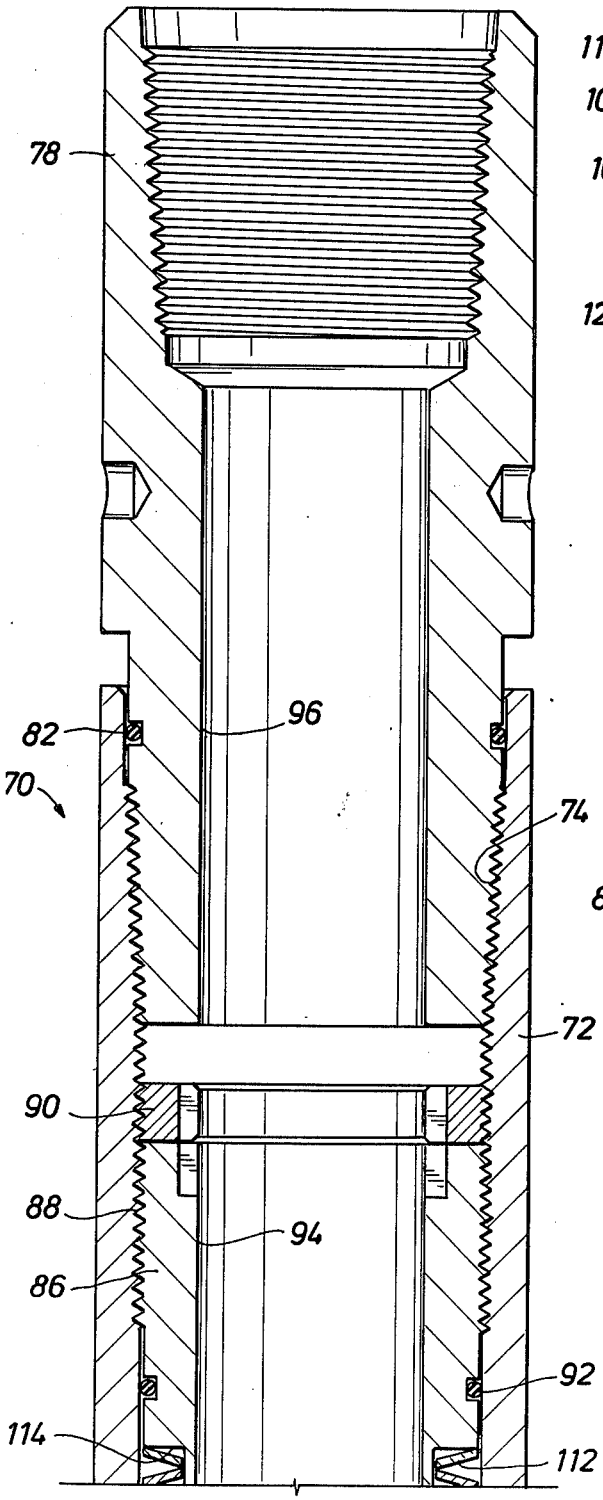
FIGS. 2A and 2B depict a sectional view of a differential pressure circulating valve representing a modified embodiment of the present invention wherein the valve mechanism incorporating an internal valve element is adapted for circulation by injection of fluid into the tubing string.
Figure 2B:
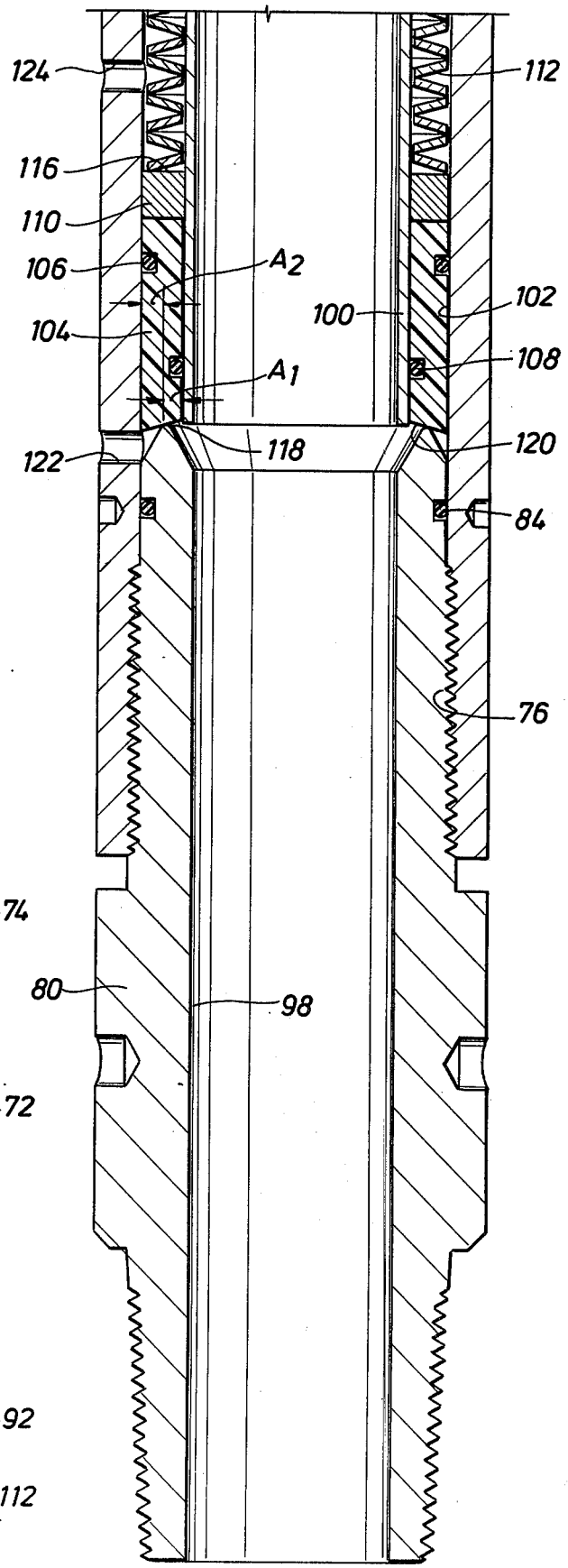

Referring now to FIGS. 2A and 2B, the present invention may effectively take the form of an equalizing valve mechanism incorporating a sleeve valve that is positioned within a valve body structure as compared to exteriorly of it as in FIG. 1. The valve mechanism shown generally at 70 incorporates an elongated tubular body member 72 having threaded segments 74 and 76 defined within each extremity thereof. Upper and lower connection submembers 78 and 80 are received respectively by the upper and lower extremities of the tubular body 72 and provide for connection of the valve mechanism to sections of production tubing making up the tubing string of the well. The connection subs are sealed with respect to the tubular body by means of sealing elements 82 and 84 which may comprise O-rings or sealing elements of any other suitable character.

Within the tubular body 72 is located a valve retainer sleeve 86 which is provided with an externally threaded upper portion 88 that is received by the upper threaded portion 74 of the tubular body. A locking member 90 is also received by the threaded portion 74 of the tubular body and functions to lock the valve retainer sleeve against inadvertent rotation. The valve retainer sleeve 86 is sealed with respect to the tubular body by means of an annular sealing element 92 which may be of any suitable form. The valve retainer sleeve defines an internal passage 94 which is of the same internal dimension as passages 96 and 98 of the upper and lower connection subs. These passages are of substantially the same internal dimension as that of the production tubing, thereby permitting passage of service tools, subsurface pump and pump rods through the valve mechanism. The valve retainer sleeve 86 further defines a depending circular skirt portion 100, forming a part of the passage 94 and being disposed in concentric, spaced relation with an internal surface 102 of the tubular body 72. Within the annular space that is defined between the depending skirt portion 100 and the cylindrical surface 102 is located a metal valve element 104 having a sealing insert 105 composed of a suitable hard plastic sealing material and which is sealed with respect to the tubular body by an annular sealing element 106 and with respect to the depending skirt portion 100 by means of an annular sealing element 108. Immediately above the valve member 104 is located an annular valve follower 110 which, if desired, may be in the form of a metal ring which functions as a positive pressure plate in contact with the hard plastic valve member. The metal ring is in place to provide a positive metal surface between the springs and plastic valve member. A spring package 112, incorporating Bellville spring washers or a spring of other suitable form is positioned in the annular receptacle defined between the depending skirt 100 and is interposed between a circular abutment shoulder 114 of the valve retainer sleeve and a circular shoulder surface 116 of the circular follower member 110. The spring package 112 is operative to urge the valve member 104 in a downwardly direction. The upper portion of the connection sub 80 is formed to define an annular valve seat 118 which is directed upwardly and which provides seating contact with a sealing surface 120 defined by the lower portion of the valve element 104 and sealing insert 105. The sealing surface 120 is of tapered annular configuration but may take any one of a number suitable forms within the spirit and scope of the present invention.

In the immediate vicinity of the valve seat surface 118 the tubular valve body 72 is formed to define one or more discharge ports 122 which represent a restriction to pressure in comparison to the valve dimension provided for inlet of injected pressure to the area of valve-valve seat contact. In a particular embodiment of this invention, a discharge port in the order of $\frac{1}{4}''$ is formed in the turbular body to thereby provide sufficient restriction thus enabling injection pressure to be maintained quite low in a valve open condition and yet maintain the valve member 104 in its open, fluid flowing condition.

In the embodiment illustrated in FIGS. 2A and 2B, a circular area A1 of the valve member 104 is exposed to pressure from the tubing at all times. Thus, in order for the valve element 104 to move from its closed position as shown in FIG. 2 to an open position it is necessary for injection pressure within the tubing to reach a particular level that, acting on valve area A1 sufficient upwardly directed resultant force is developed to overcome the closing force developed on the valve by the spring package 112. As soon as this closing force is overcome, the valve element 104 is shifted upwardly thereby breaking the seal between the sealing surface 120 and the seat surface 118. Thereafter, a valve area A2 is exposed to injection pressure from the tubing. Injection pressure therefore acting on valve area A2 develops a much greater force at injection pressure thereby quickly shifting the valve member 104 to its full open position. After the valve has moved to its open position, the injection pressure may be substantially lowered and yet sufficient pressure induced force will be developed on the valve member to maintain it open against the compression of the spring package 112. An equalizing port 124 is formed in the tubular body 72 to establish communication between the spring chamber and the annulus. When injecting fluid under pressure from the tubing, the annulus will be at a lower pressure and this lower pressure will be communicated via port 124 into the chamber within which the spring package 112 is located. Annulus pressure will therefore act upon the follower member 110 and the valve member 104 but will be overcome by the injection pressure acting on the lower portion of the valve thereby developing a force differential or resultant force acting upon the spring package 112.

The valve element and the spring package 112, being disposed inwardly of the tubular body 72 are protected from mechanical damage such as might be caused by contact with objects located within the casing.

Figure 3:
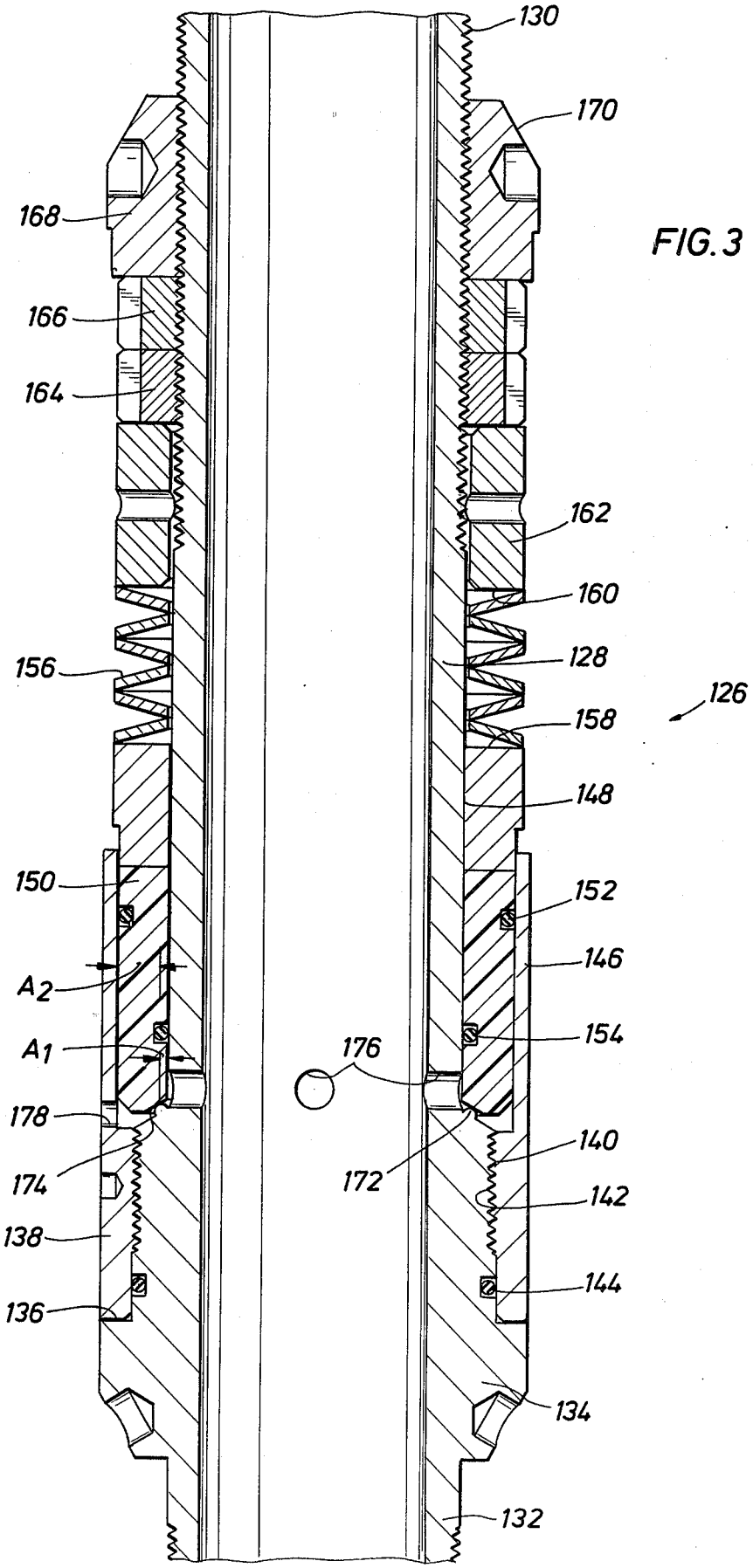
FIG. 3 is a sectional view of a further modified embodiment of the present invention wherein a differential pressure circulating valve is shown having an external sleeve valve member and which is operated by pressure injection into the tubing string.

The invention may take another suitable form as shown in the sectional view of FIG. 3 wherein an external sleeve valve is employed in accordance with the present principles to achieve circulation from the tubing into the annulus of the well. As shown in FIG. 3, the valve mechanism, generally illustrated at 126, incorporates an elongated tubular body 128 having upper and lower threaded extremities 130 and 132 which adapt the body for connection to sections of production tubing. Adjacent its lower portion, the body structure 128 forms an enlargement 134 presenting an upwardly directed annular shoulder 136 for engagement by the lower portion of a valve retainer member 138. An externally threaded portion 140 of the enlargement 134 is provided to receive an internally threaded portion 142 of the valve retainer. The valve retainer is sealed with respect to the tubular body structure by means of an annular sealing element 144 such as an O-ring or the like. The valve retainer also defines an upwardly directed annular skirt portion 146 which is disposed in concentric spaced relation with a cylindrical surface 148 defined by an intermediate portion of the tubular body 128. A generally cylindrical sleeve valve element 150 composed of relatively hard plastic sealing materials is positioned in surrounding relation with the tubular body 128 and is received within an annular valve receptacle formed between the skirt element 146 and the cylindrical surface 148. The sleeve valve is sealed with respect to the skirt by an annular sealing element 152 and is sealed with respect to the tubular body by means of annular sealing element 154.

A spring package 156 is positioned about the tubular body 128 with the lower portion thereof bearing against a shoulder surface 158 of a metal follower ring 157 interposed between the valve element and spring package. The upper portion of the spring package bears against an opposed annular abutment surface 160 defined by a generally cylindrical spacer or follower 162. A pressure setting nut 164 is received by the threaded portion 130 of the tubular body and is adjustable to provide predetermined compression of the spring package 156. A lock nut 166 is provided to secure the pressure setting nut in immovable relation on the tubular body. An upper guide ring 168 is threadedly received by the upper portion of the tubular body and functions as an additional lock nut. The guide ring forms a tapered upwardly directed surface 170 which provides a guiding function as the circulating valve is moved upwardly, thus preventing the circulating valve from becoming fouled on any internal protrusion or other object within the casing.

At the upper portion of the annular enlargement 134 of the tubular body is provided a circular valve seat ridge 172 which is disposed for sealing contact with an annular tapered sealing surface 174 defined by the lower portion of the valve element 150. In the immediate vicinity of the valve seat 172 the tubular body 128 defines a plurality of inlet openings 176 which admit pressurized fluid from the tubing to the point of sealing engagement between the valve seat 172 and the sealing surface 174. At least one discharge port 178 is formed in the skirt portion 146 of the valve retainer such that annulus pressure is communicated to the point of sealing contact between the valve element and the seat ridge 172. Although shown as a single discharge port 178, it should be borne in mind that a plurality of discharge ports may be provided so long as the cross-sectional area of the discharge ports is significantly less than the cross-sectional area defined by the inlet openings or ports 176.

Circular sealing contact between the seat rim 172 and the sealing surface 174 defines a pressure responsive area A1 of the valve sleeve 150 which is exposed to injection pressure from the tubing. Area A2 of the sleeve valve defines an area of the lower portion of the sleeve valve which is exposed to pressure from the casing. Of course, the upper portion of the valve member is entirely exposed to casing pressure. As injection pressure is increased within the tubing, it acts upon valve area A1 thereby developing a pressure induced force acting upwardly against the compression of the spring package 156. As soon as the preset force of the spring package is overcome by tubing pressure acting against valve area A1, the valve member will shift to its open position breaking the seal between the seat ridge 172 and the sealing surface 174. Thereafter, tubing pressure will be communicated into the lower portion of the valve receptacle and will act against both areas A1 and A2 at the lower portion of the valve. Because the valve inlet ports 176 define a much greater cross-sectional area as compared to the cross-sectional area of the outlet port or ports 178, the fluid pressure within the valve receptacle may be maintained substantially at injection pressure depending upon design factors such as the dimension of the discharge port, etc. From a visual comparison of the areas A1 and A2, it is apparent that, upon valve opening, the valve member 150 will be subjected to approximately three times the pressure induced force developed prior to valve opening. The consequent result therefore is that the valve member 150 will quickly move to its fully open position due to the increased force that is developed upon valve unseating. Thereafter, the injection pressure may be substantially reduced and yet the pressure induced force acting upon the valve member will maintain the valve in its open position so long as the rate of flow of the injected fluid is such as to maintain the pressure necessary to maintain the sleeve valve in the open position against the mechanically induced spring force.

Figure 4:
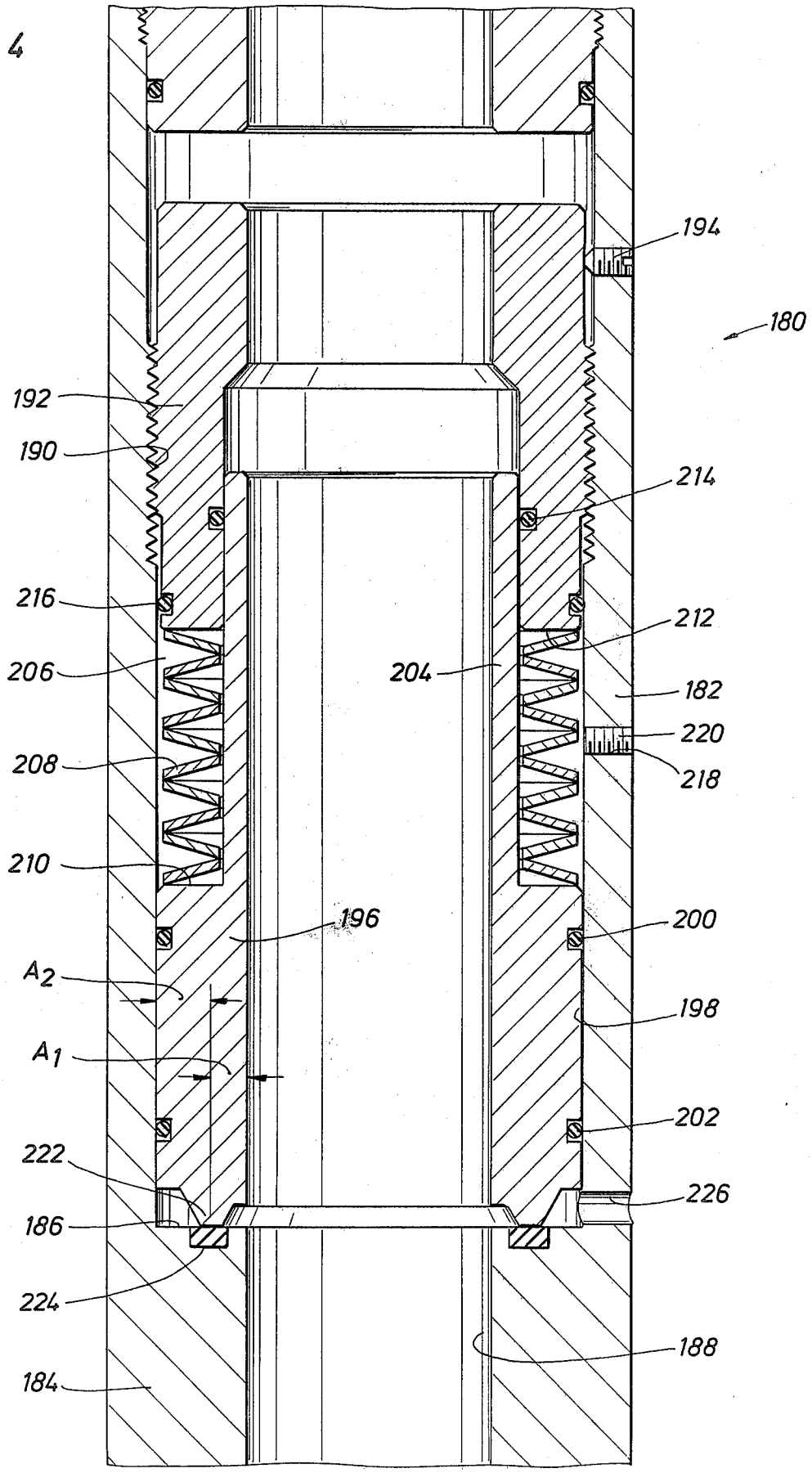
FIG. 4 is a partial sectional view of a further modified embodiment of the present invention wherein an internal sleeve valve mechanism is illustrated and which is operated by pressure injection into the tubing string.

As illustrated in FIG. 4, the circulating valve mechanism of this invention may take another form with the valve member located interiorally of the valve housing. As shown generally at 180 the circulating valve incorporates a tubular outer body structure 182 having a reduced diameter internal portion provided at 184 which defines an upwardly directed seat shoulder 186 and forms a cylindrical passage 188 which is of the same dimension as the internal passage of the tubing to which the circulating valve is connected. Intermediate its extremities the tubular body 182 is formed to define an internally threaded portion 190 which is adapted to receive the externally threaded portion of a valve and spring retainer member 192. The retainer member is adapted for adjustment within the tubular body to control the mechanical seating pressure of an internal valve member. When properly adjusted the retainer member is locked in place by means of a set screw 194 or any other suitable locking element.

An internal sleeve valve element 196 is positioned within the tubular body 182 and is sealed with respect to a cylindrical internal surface 198 by means of annular sealing elements 200 and 202. The sleeve valve element is also formed to define an upstanding internal skirt member 204 which is disposed in concentric, spaced relation with the internal surface 198 of the tubular body 182 and thereby defines a spring chamber 206 within which is located a spring package 208 which may comprise Bellville washer type spring elements as shown or, in the alternative, may comprise a helical compression spring. The lower extremity of the spring package bears against an upwardly directed shoulder 210 of the valve element 196 while its upper extremity is restrained by a downwardly directed shoulder 212 of the retainer element 192. A seal is developed between the upstanding skirt 204 and the retainer element 192 by means of an annular sealing element 214. The retainer member is sealed with respect to the tubular body by means of a sealing element 216. The tubular body is formed to define a port 218 through which communication may be established between the annulus and the spring chamber 206. Valve element 196 is formed to define a downwardly directed sealing rim 222 which is positioned for sealing engagement with a circular seat 224 located in the seat shoulder 186. The sealing rim 222 is of circular form and is so positioned with respect to the total circular area of the valve member that valve areas A1 and A2 are defined. Valve area A1 is exposed to pressure from the tubing while valve area A2 is exposed to pressure from the annulus via one or more discharge ports 226. The spring induced force acting downwardly on the valve member 196 determines the pressure requirements for opening the valve. Injected pressure into the tubing, acting upon valve area A1 develops a pressure induced upwardly directed force opposing the downward force of the spring package 208. When this upwardly directed force is sufficient to overcome the force of the spring package, the valve opens and the entire valve area including areas A1 and A2 become exposed to pressure from the tubing. Simultaneously, fluid under pressure will begin its discharge from the tubing through the restricted discharge port 226. Because of the increased valve area that is exposed to tubing pressure in the open position of the valve, the valve member will be shifted immediately to its full open position and will remain open even though injected pressure drops to a pressure level well below the pressure required to open the valve so long as the rate of flow of the injected fluid is such as to maintain the pressure necessary to maintain the sleeve valve in the open position against the mechanically induced spring force.

Figure 5:
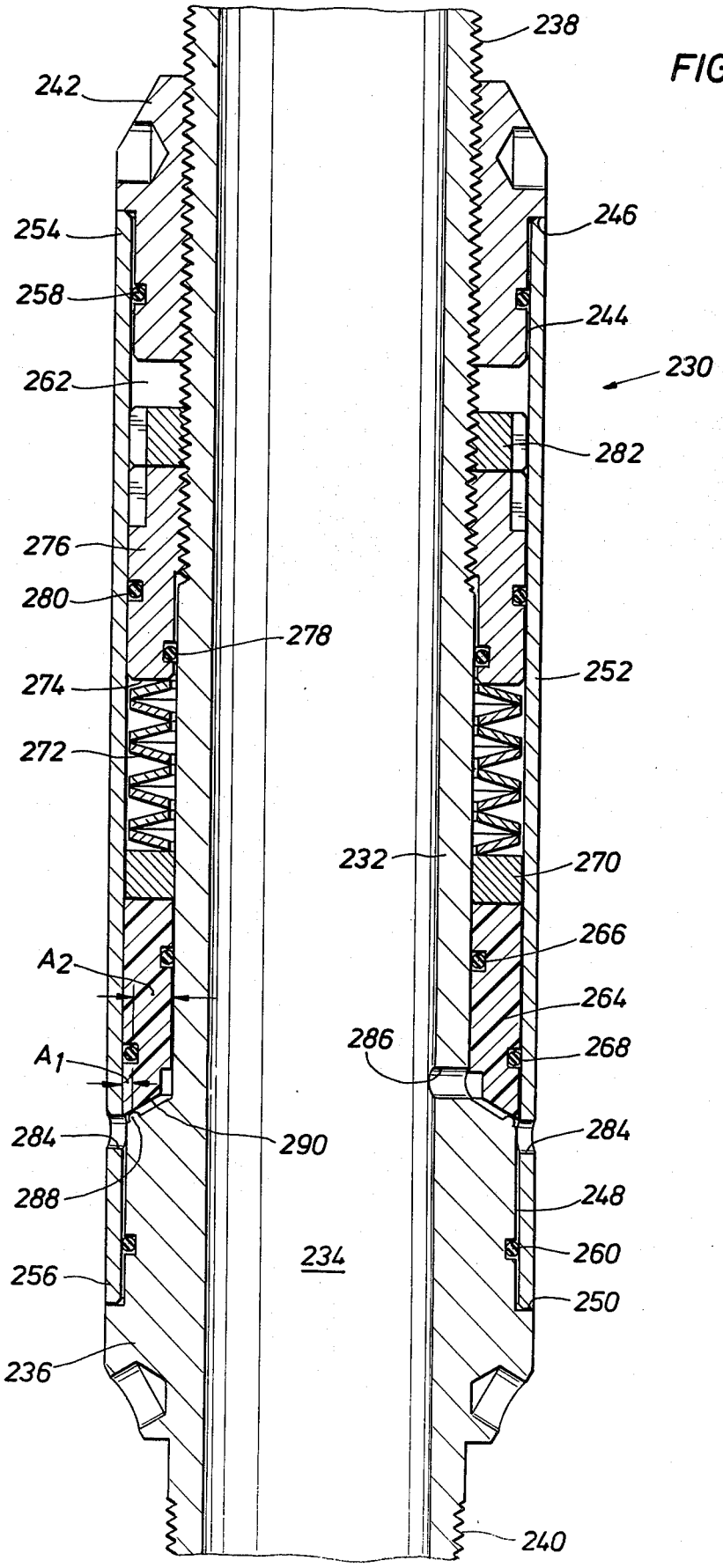
FIG. 5 is a sectional view of a modified embodiment of this invention incorporating an external sleeve valve and which is operated by pressure injection into the annulus.

For pressure injection from the annulus into the tubing the valve mechanism of this invention may take another convenient form such as shown generally at 230 in FIG. 5. In this embodiment the valve mechanism incorporates an elongated tubular body member 232 which defines a flow passage 234 of generally the same dimension as the internal dimension of the tubing sections located above and below the valve. The tubular body 232 incorporates an annular enlargement 236 adjacent its lower extremity and forms upper and lower threaded portions 238 and 240 for connection of the circulating valve to the tubing sections. A body sleeve retainer element 242 is threadedly received by the upper threaded portion 238 of the tubular body and defines a reduced diameter portion 244 forming an abutment shoulder 246. Likewise, the lower enlargement 236 of the tubular body forms a reduced diameter portion 248 and an upwardly directed annular abutment shoulder 250. An elongated pressure containment sleeve 252 is positioned in concentric, spaced relation about the tubular body with end portions 254 and 256 received in closely spaced relation about the reduced diameter portions 244 and 248. The pressure containment sleeve 252 is sealed with respect to the body and retainer by means of annular sealing elements 258 and 260.

The pressure containment sleeve 252 cooperates with the tubular body to define an annular elongated chamber 262 within which is located a valve and spring assembly for which the sleeve 252 provides mechanical protection against contact with external objects within the casing. The valve and spring assembly incorporates a circular sleeve valve 264 formed of relatively hard plastic sealing material and which is movably positioned within the chamber 262 and which is sealed with respect to the body and pressure containing sleeve by means of annular sealing elements 266 and 268. A circular metal follower ring 270 is positioned in contact with the upper portion of the sleeve valve 264 and functions as a positive pressure plate follower. A compression spring package 272 incorporating Bellville spring washers as shown or a helical spring is positioned with its lower extremity in contact with the ring member 270 and with its upper extremity in engagement with an abutment surface 274 defined by a spring adjustment element 276. The spring adjustment element is sealed with respect to the body and sleeve by means of sealing elements 278 and 280. The retainer member 276 defines internal threads which are received by the externally threaded portion of the tubular body. A locking member 282 is also received by the upper threaded portion 238 of the tubular body and functions to lock the spring adjustment member 276 against inadvertent movement.

Since in the embodiment of FIG. 5 the valve mechanism is designed to accommodate flow of injected fluid from the annulus into the tubing, the pressure-containing sleeve 252 is formed to define a plurality of inlet ports 284 which permit fluid from the annulus to enter the lower portion of the chamber 262 below the valve element. The tubular body 232 is formed to define restricted port means 286 communicating the annular chamber 262 with the flow passage of the tubing. The port means 286 may be defined by one or more restricted ports defining a smaller cross-sectional dimension as compared to the combined cross-sectional dimensions of the inlet ports 284. The annular enlargement 236 of the tubular body defines a circular seating rim 288 which is disposed for sealing engagement with a tapered sealing surface 290 of the sleeve valve member 264. The sealing rim 288 is positioned relative to the valve member such that contact between the sealing rim and the seat surface defines an area A1 of the valve member which is exposed to injected pressure from the annulus. Likewise, such positioning of the sealing rim develops an area A2 of the valve member which is exposed to the pressure conditions of the tubing. As the annulus pressure is increased during injection of fluid, area A1 of the valve member will be responsive to the annulus pressure and an upwardly directed pressure induced force will be developed on the valve member. As soon as this opening force is sufficiently great to overcome the downwardly directed force developed by the compression spring package 272 the valve member 264 will begin to move upwardly. As soon as upward movement of the valve member begins, the seal between the sealing ridge 288 and sealing surface 290 will be broken, thereby communicating the higher annulus pressure into the lower portion of annular chamber 262 below the valve element. Since the port or ports 286 define a restriction to flow as compared to the port dimension provided at the inlet openings 284 the fluid pressure acting on the bottom surface area of the valve member will be only slightly lower than inlet pressure except as affected by discharge port dimension and other design factors. The increase in valve surface area that is exposed to the pressure will significantly increase the upwardly directed resultant force that is applied through the sleeve valve to the compression spring package 272. The valve member will therefore shift quite readily to its full open position. After initial opening the annulus pressure may be significantly decreased while maintaining the valve member in an open condition. This feature allows fluid circulation at lower pressure while maintaining the valve member at a full flow position so long as the rate of flow of the injected fluid is such as to maintain the pressure necessary to maintain the sleeve valve in the open position against the mechanically induced spring force. An equalizing port 292 is formed in the tubular body 232 to prevent any hydraulic interference with valve movement.

Figures 6A, 6B:
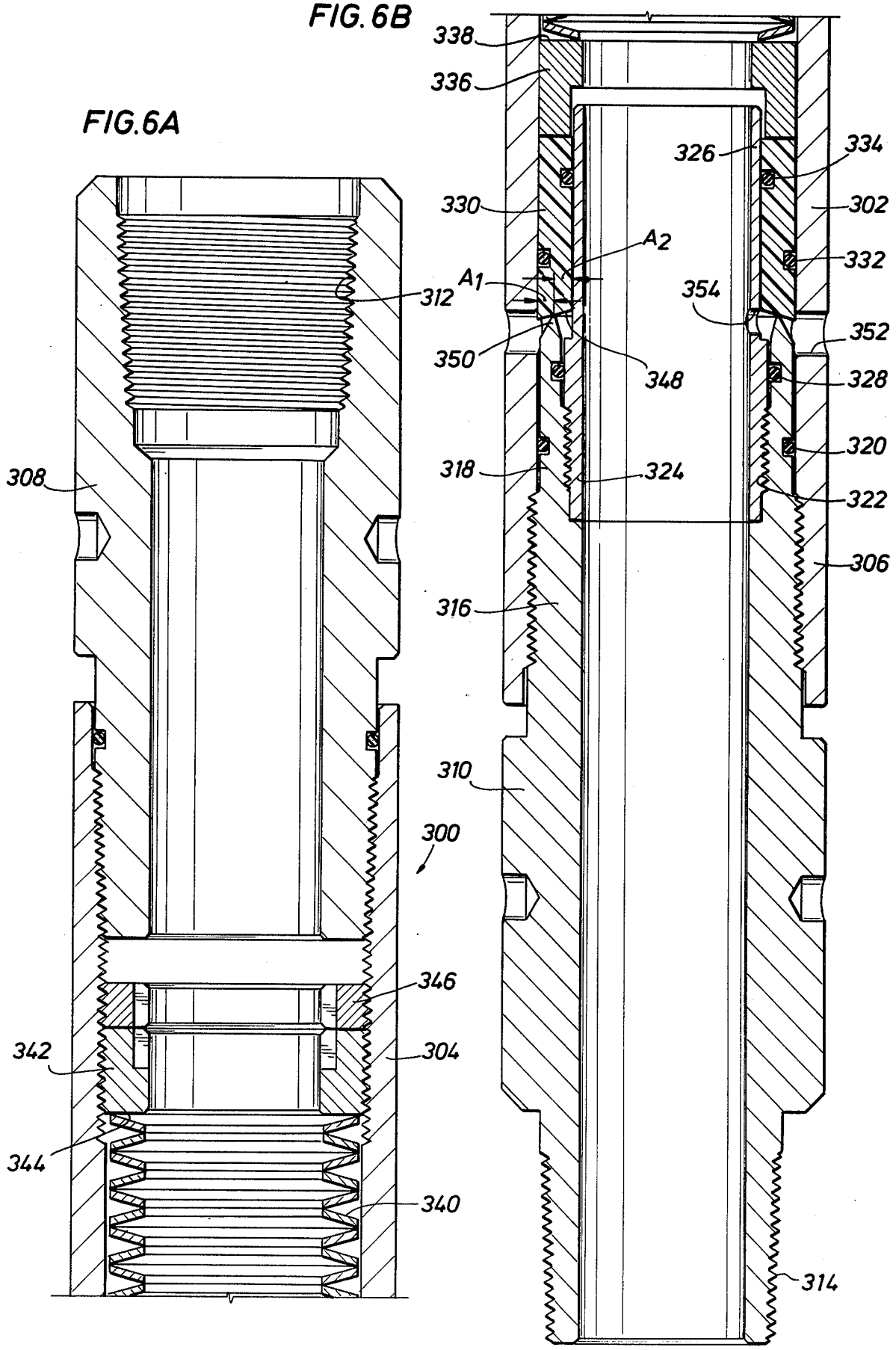
FIGS. 6A and 6B are sectional views of a circulating valve representing a further modified embodiment of this invention which incorporates an internal sleeve valve functioning responsive to pressure injection into the annulus.

FIGS. 6A and 6B illustrate a modified valve construction wherein a reciprocating sleeve valve member is disposed within a valve housing and is responsive to injected fluid pressure in the annulus of the well to thereby allow flow of circulating fluid from the annulus into the tubing and upwardly through the tubing string to surface production equipment. The valve mechanism, illustrated generally at 300, incorporates a tubular body structure 302 which is formed to define internally threaded extremities 304 and 306 receiving upper and lower connector subs 308 and 310 in assembled relation therewith. The upper and lower connector subs are formed to define respective box and pin connections 312 and 314 for connection of the valve 300 in assembled relation with the tubing string of the well. The lower connector sub 310 is formed to define an upwardly directed externally threaded portion 316 which is received within the internally threaded lower extremity 306 of the tubular body 302. An annular seat projection 318 extends upwardly from the the annular portion 316 and is positioned within the tubular body 302. A circular sealing element 320 of any suitable character establishes a sealed relationship between the seat projection 318 and the tubular body 302. The seat projection defines an internally threaded portion 322 which receives the lower externally threaded portion 324 of an upwardly directed valve retainer skirt 326. A sealing element 328 establishes a sealed relationship between the seat projection 318 and the valve retainer skirt 326. The valve retainer skirt is disposed in concentric, spaced relation with the tubular body 302 and defines a circular chamber within which is disposed a sleeve valve member 330 which is composed of relatively hard plastic sealing material. The sleeve valve member 330 is sealed with respect to the tubular body by means of a circular sealing element 332 and with respect to the valve retainer skirt 326 by means of a circular sealing element 334.

A circular pressure plate ring 336 is positioned above and in engaging relation with the sleeve valve 330 and provides an upper abutment surface 338 which is engaged by the lower extremity of a compression spring package 340. A pressure setting ring 342 is received by the internal body threads at the upper portion of the body tube and defines a downwardly directed shoulder surface 344 which bears against the upper portion of the spring package. The pressure setting ring 342 is adjusted by rotating it to thus achieve application of a desired mechanical force to the plate ring 336 and sleeve valve 330. A locking ring 346 secures the pressure setting ring against inadvertent movement within the valve body.

The sleeve valve member 330 defines a tapered lower sealing surface 348 which is disposed for sealing engagement with an annular seat rim 350 formed at the upper extremity of the seat projection 318. The circular dimension of the seat rim in comparison to the dimension of the tapered sealing surface 348 exposes a small valve area A1 to pressure from the annulus via a plurality of inlet ports 352. A larger valve area A2 is exposed to the pressure of the tubing via a restricted discharge port 354 which is formed in the valve retainer skirt 326. As fluid pressure is increased in the annulus between the tubing and casing during injection, this pressure will bear against valve surface area A1 thus developing an upwardly directed resultant force which opposes the downwardly directed force applied by the compression spring package 340. As soon as the force of pressure acting against surface area A1 exceeds the downwardly directed force of the compression spring the valve member 330 will become unseated and begin to move upwardly. Immediately on this occurrence the annulus pressure will act on valve areas A1 and A2, thereby developing a much greater upwardly directed resultant force. This resultant force drives the sleeve valve upwardly to its full open position thereby permitting circulating flow to occur through the discharge port 354. The discharge port, however, is of restricted dimension as compared to the dimension of the inlet ports 352, thereby maintaining a pressure within the valve chamber which is only slightly lower than annulus pressure. After valve opening has occurred, the injected pressure in the annulus may be substantially decreased and yet the sleeve valve member will remain fully open to thereby permit full flow from the annulus into the tubing as allowed by the restricted discharge port 354 so long as the rate of flow of the injected fluid is such as to maintain the pressure necessary to maintain the sleeve in the open position against the mechanically induced spring force.

Figure 7:
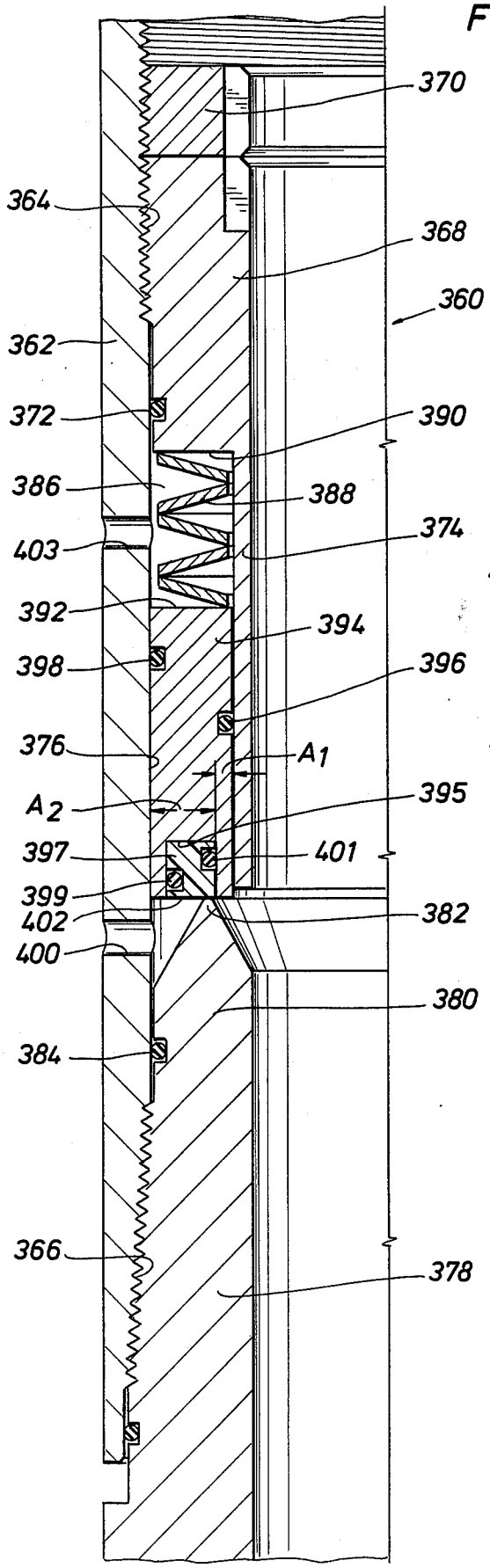
FIG. 7 is a quarter sectional view of a circulating valve representing an alternative embodiment of this invention wherein a sleeve valve member composed of a relatively hard plastic sealing material such as Hytrel is employed for sealing purposes and is strengthened against pressure expansion by an outer metal band.

Referring now to FIG. 7, a modified embodiment of the present invention is disclosed generally at 360 which includes an outer housing structure 362 which is formed to define internally threaded portions 364 and 366. A valve retainer member 368 is received by the internally threaded portion 364 of the housing and is locked in place by means of a locking ring 370. The valve retainer element is sealed to the body 362 by means of an O-ring sealing member 372 and defines a depending circular skirt portion 374 which is disposed in concentric, spaced relation with the inner surface 376 of the body structure. The lower connector member 378 of the circulating valve defines a circular sealing portion 380 that extends upwardly and is formed to define a circular seat ridge 382. A circular sealing member 384 seals the circular sealing projection 380 relative to the inner cylindrical surface 376 of the body.

Within the circular space 386 between the valve retainer skirt 375 and cylindrical surface 376 is received a spring package 388 which bears against downwardly directed shoulder 390 of the retainer 368 and develops a spring force tending to urge the valve member downwardly. The lower portion of the spring package engages the upper shoulder portion 392 of a sleeve valve member 394. Sealing members 396 and 398 seal the valve member against the cylindrical surface 376 and valve retainer skirt 374. The sleeve valve member 394 defines a recess 395 at its lower extremity which receives a circular sealing insert 397 which may be composed of a relatively hard sealing material such as the sealing material sold under the registered trademark Hytrel by E. I. DuPont De Nemours & Company. The insert 397 is sealed to the walls of the recess 395 by O-ring sealing members 399 and 401. An equalizing port 403 in the housing tube 362 prevents hydraulic interference with valve movement.

The valve body structure 362 if formed to define a restricted discharge orifice 400 through which fluid pressure injected into the tubing string is discharged into the annulus of the well upon opening of the valve member 394. Sealing contact between the circular seat ridge 382 and the annular sealing surface 402 of the sleeve valve insert establishes circular areas of the valve member which are exposed to pressure form the tubing string and from the annulus. Valve area A1 is exposed to tubing pressure while valve area A2 is exposed to the pressure conditions of the annulus. The sleeve valve member 394 will respond to pressure changes in the tubing and annulus and will function essentially in the same manner as discussed above in connection with FIG. 2B.

Figure 8:
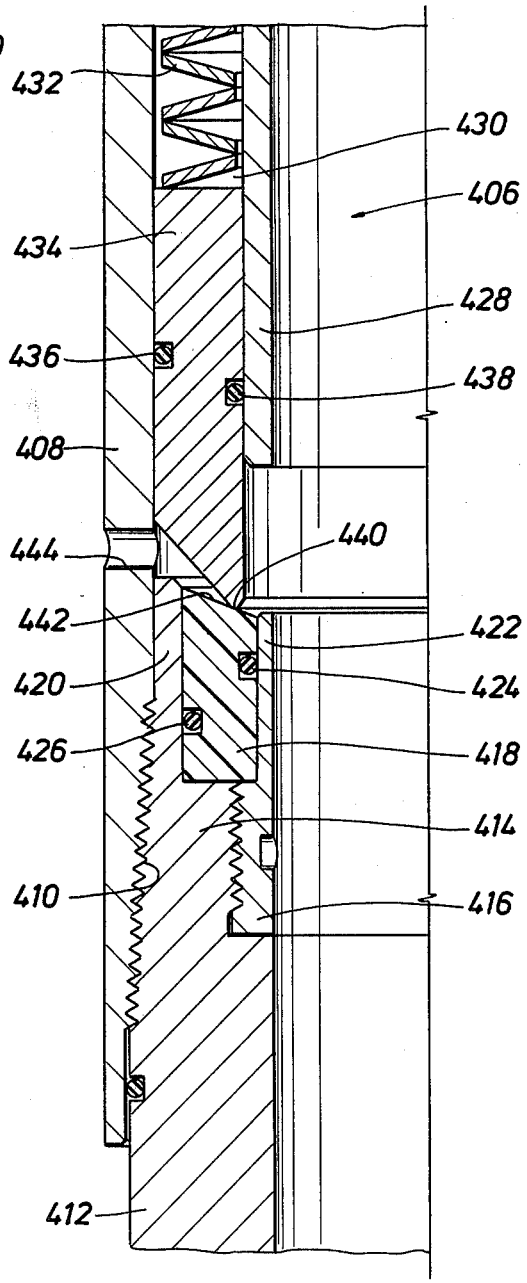
FIG. 8 is a quarter sectional view of a circulating valve representing another embodiment of this invention wherein a relatively hard plastic seat member is retained within a seat groove and is engaged by a metal sleeve valve to establish sealing contact.

Plastic material such as Hytrel may also be utilized as a seat member wherein sealing contact is established therewith by means of a movable metal sleeve valve element. As shown in FIG. 8, a circulating valve is illustrated generally at 406 which has an external tubular body 408 having an internally threaded portion 410 to which is received the lower connector portion 412 of the circulating valve in the manner generally shown in FIGS. 2B and 6B. The connector member 412 defines an upstanding valve seat projection 414 to which is secured a seat retainer member 416. A sealing member 418, composed of a relatively hard plastic sealing material of any suitable form is received between spaced circular upstanding skirts 420 and 422. Circular sealing members 424 and 426 seal the seat member with respect to the upstanding circular sealing skirts.

A depending valve retainer skirt 428 is positioned in concentric spaced relation with respect to the tubular body 408 and defines a circular space 430 within which is received a spring package 432 and a sleeve valve member 434. Sealing elements 436 and 438 seal the sleeve valve member relative to the body 408 and the depending valve retainer skirt 428. The sleeve valve element 434 defines an inner sealing ridge 440 of circular form which bears against a tapered upper seat surface 442 of the seat member 418. The outer body 408 defines one or more discharge ports 444 through which fluid pressure is injected from the tubing into the annulus of the well upon unseating of the valve member. The valve member functions responsive to differential pressure in the same manner discussed above in connection with FIG. 7 and other figures of the drawings.

Figure 9:
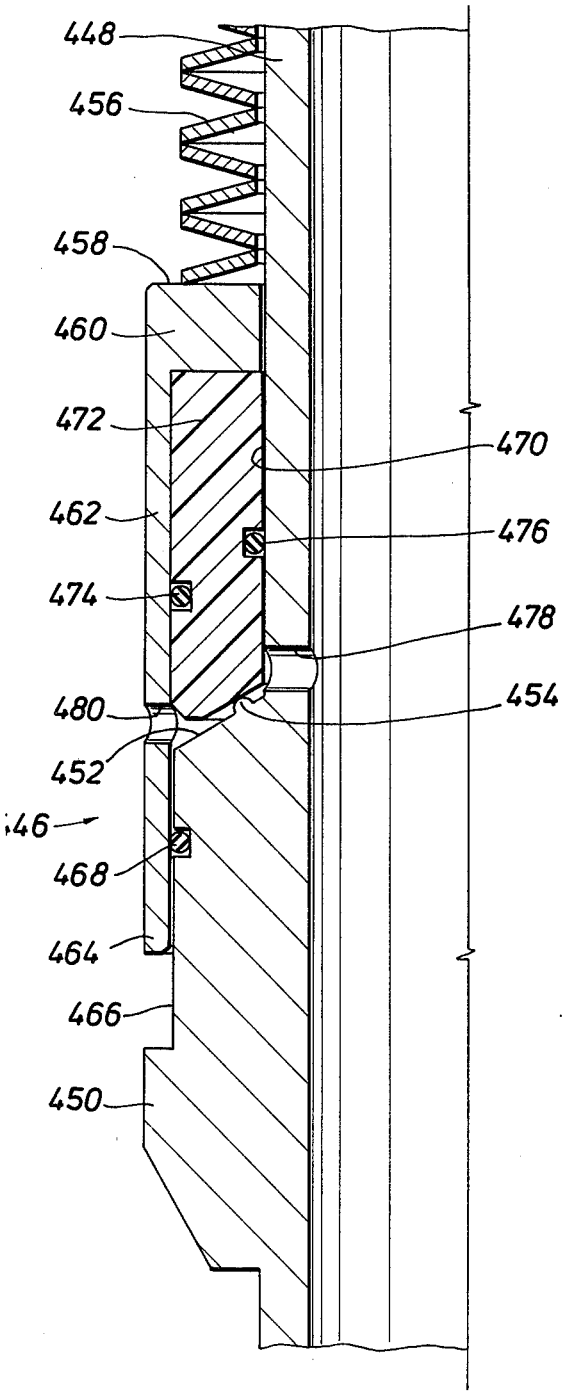
FIG. 9 is a quarter sectional view of a circulating valve having an external sleeve valve with a circular body of relatively hard plastic sealing material disposed therein to establish sealing engagement with the valve seat and wherein the external sleeve containment member moves in conjunction with the plastic sealing material.

Referring now to FIG. 9, a circulating valve is shown generally at 446 which represents a further embodiment of the invention wherein an external sleeve valve is employed. The valve mechanism incorporates an elongated tubular body portion 448 having a lower enlargement 450 defining an upwardly directed tapered shoulder 452 with a circular seat ridge 454 located thereon. A spring package 456 is disposed about the tubular body 448 with the lower portion thereof bearing against an upwardly directed shoulder 458 of a sleeve valve member 460. The sleeve valve incorporates an integral depending seal retainer skirt 462 having the lower portion 464 thereof extending in closely spaced relation about a cylindrical surface 466 defined by the valve body. A circular sealing member 468 seals the skirt member 462 against the enlarged portion 450 of the body structure.

The depending seal retainer skirt 462 cooperates with a cylindrical outer surface 470 of the body to form a circular seal receptacle within which is disposed a circular body of suitable hard sealing material 472 such as DuPont Hytrel. The body of sealing material is sealed against the skirt 462 by O-ring 474 and is sealed against the body by O-ring 476.

Communication between the tubing and annulus is defined by a plurality of inlet openings 478 in the tubular body which communicate fluid pressure to the circular seat ridge 454 from the tubing. A restricted discharge port 480 in the seal retainer skirt 462 communicates the annulus of the well with the seat ridge 454.

It should be borne in mind that the seat member 460 is adapted to move upwardly and downwardly responsive to pressure induced force and spring developed force. The sealed retainer member 460 is composed of metal or any other suitable rigid material and the circular sleeve type sealing member 472 may be composed of any one of a number of suitable relatively hard plastic materials. The lower tapered sealing face of the sealing member 472 engages the seat ridge 454 in such manner that annular pressure responsive areas of the seat member 472 are developed in the manner shown at A1 and A2 in FIG. 1. The plastic seat member moves along with the metal seat retainer member 460 as the sleeve valve member opens and closes responsive to fluid pressure and spring induced force.

Figure 10:
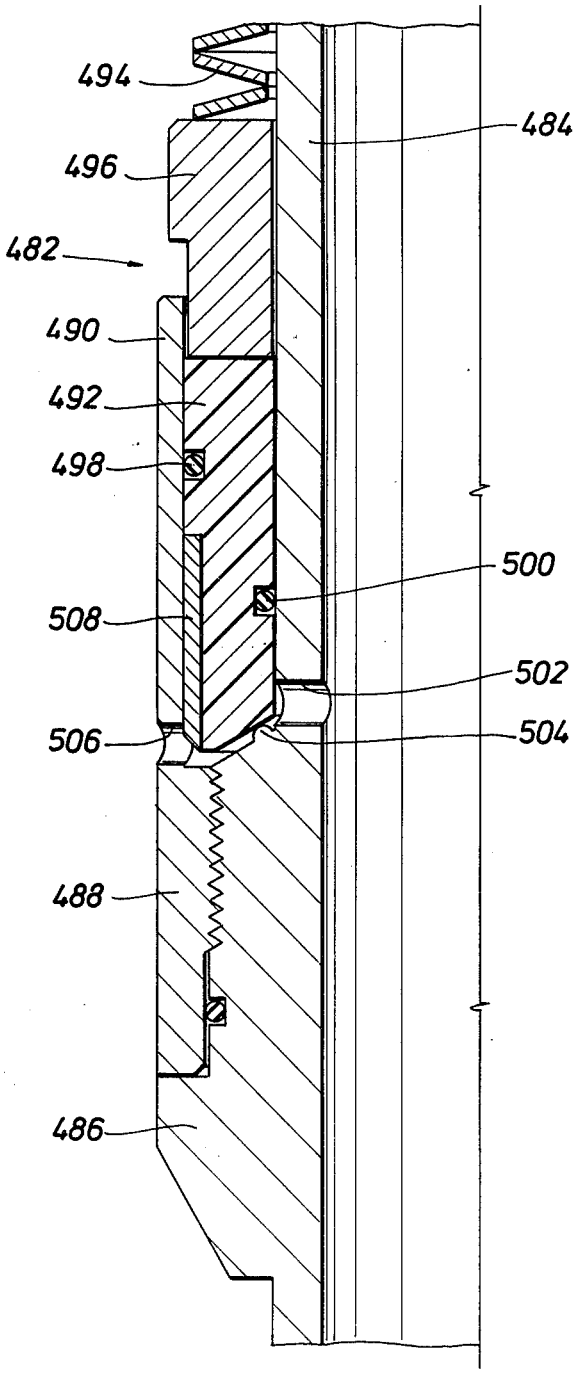
FIG. 10 is a quarter sectional view of a circulating valve mechanism having an external valve sleeve composed of a hard plastic material such as Hytrel and which is strengthened by means of an external metal band against pressure expansion and wherein the external sleeve containment member is fixed, within which the plastic sealing material moves in an opening and closing direction.

Referring now to FIG. 10, a further modified embodiment of the present invention is disclosed generally at 482 wherein an inner tubular body 484 is provided having a lower enlargement 486. A valve retainer member 488 is connected by threads to the enlarged portion of the tubular body and provides an upstanding valve retainer skirt 490 which is positioned in spaced, concentric relation with the tubular body 484, thus defining an upwardly opening valve receptacle. A sleeve valve member 492, composed of relatively hard plastic sealing material is positioned for reciprocation within the valve receptacle and is urged toward its closed position by means of a spring package 494 bearing against a follower member 496. The valve member 492 is sealed against the upstanding skirt by an O-ring sealing member 498 and is sealed against the tubular body by an O-ring sealing member 500. The tubular body defines a plurality of inlet openings 502 which communicate fluid pressure from the tubing to a circular seat ridge 504. Likewise, a discharge port 506 of restricted dimension is formed in the valve retainer member 488 and communicates fluid pressure from the annulus to the seat ridge 504. To compensate for any likelihood that the lower portion of the sleeve valve member might expand due to pressure and become locked against the valve retainer skirt 490, the lower portion of the sleeve valve is strengthened by means of an external metal sleeve 508. Valve member 492 is responsive to spring force and pressure induced force in the same manner as discussed above in connection with FIG. 1.

While the foregoing is directed to the preferred embodiments of the present invention, other and further embodiments of the invention may be devised without departing from the basic concept thereof, and the scope thereof is determined by the claims which follow.

What is claimed is:

1. A circulating valve for connection into the tubing string of a well for establishing selective flow of fluid between the tubing string and well casing, said circulating valve comprising:

(a) valve body means adapted for connection to sections of tubing and defining a flow passage in registry with the flow passage of the tubing string, said valve body means defining valve chamber means and having inner and outer concentric sealing means;

(b) seat means being disposed within said valve chamber means;

(c) valve means being movable within said valve chamber means and engaging said seat means in the closed condition thereof, said valve means establishing sealing engagement with said inner and outer concentric sealing means;

(d) said valve body means defining inlet opening means upstream of said seat means and permitting flow of fluid into said valve chamber to said seat means; and (e) said valve body means further defining outlet opening means downstream of said seat means, said outlet opening means being of less dimension as compared to the dimension of said inlet opening means, said outlet opening means permitting maintenance of injection pressure level within said valve chamber and acting on said valve means after differential pressure opening of said valve means said injection pressure to maintain said valve means open.

2. A circulating valve as recited in claim 1, wherein:

(a) said seat means in the closed condition of said valve means defines first and second pressure responsive valve areas, said first pressure responsive valve area being exposed to injection pressure and said second pressure responsive valve area being exposed to pressure downstream of said seat means; and (b) injection pressure acting upon said first pressure responsive valve area required to open said valve means and acting upon said first and second pressure responsive valve areas to maintain said valve open, whereby said valve means is capable of being maintained open at less pressure than is required for opening of said valve means.

3. A circulating valve as recited in claim 2, wherein: said second pressure responsive valve area is of greater dimension than said first pressure responsive valve area.

4. A circulating valve as recited in claim 1, wherein: spring means urges said valve means toward said seat means.

5. A circulating valve as recited in claim 1, wherein:

(a) said inner and outer concentric sealing means is formed by concentric spaced cylindrical sealing surfaces; and (b) said valve means establishes sealing engagement with said concentric spaced cylindrical sealing surfaces.

6. A circulating valve as recited in claim 1, wherein said body means comprises:

(a) an elongated integral tubular body forming said flow passage and having an inner cylindrical sealing surface forming said inner concentric sealing means, said tubular body further being formed to define said inlet opening means;

(b) a pressure containment sleeve being secured in fixed relation to said tubular body and defining an internal cylindrical wall spaced from said tubular body and forming an outer cylindrical sealing surface disposed in concentric relation with said inner cylindrical sealing surface and forming said outer concentric sealing means; and (c) said valve means having inner and outer sealing means disposed in respective sealing engagement with said inner and outer cylindrical sealing surfaces.

7. A circulating valve as recited in claim 6, wherein:

(a) said inlet opening means is defined by said tubular body; and (b) said outlet opening means is defined by said pressure containment sleeve.

8. A circulating valve as recited in claim 6, wherein:

(a) said pressure containment sleeve is located internally of said tubular body; and (b) said valve means is located internally of said tubular body.

9. A circulating valve as recited in claim 6, wherein:

(a) said pressure containment sleeve is located externally of said tubular body; and (b) said valve means is located externally of said tubular body.

10. A circulating valve for connection into the tubing string of a well for establishing selective flow of fluid between the tubing string and well casing, said circulating valve comprising:

(a) valve body means adapted for connection to sections of tubing and defining a flow passage in registry with the flow passage of the tubing string, said valve body means having inner and outer concentric sealing means;

(b) seat means being provided on said valve body means;

(c) valve means being movably supported relative to said valve body means and establishing sealing engagement with said inner and outer concentric sealing means, said valve means engaging said seat means in the closed condition thereof, said valve means being moved to the open position thereof by differential pressure across said seat means, said valve means and said seat means cooperatively defining a first pressure responsive valve area upstream of said seat means and a second pressure responsive valve area downstream of said seat means;

(e) means urging said valve means toward said seat means; and (f) outlet opening means of said circulating valve being located downstream of said seat means and being of sufficiently restricted dimension to permit opening of said valve means by opening injection pressure acting upon said first pressure responsive area and maintenance of said valve means at the open position thereof by injection pressure acting simultaneously on said first and second pressure responsive valve areas.

11. A circulating valve as recited in claim 10, wherein:

said outlet opening means is defined by said valve body means.

12. A circulating valve as recited in claim 10, wherein:

said outlet opening means is defined by said valve means.

13. A circulating valve as recited in claim 10, wherein said valve means comprises:

(a) a sleeve valve element surrounding at least a portion of said valve body means and being linearly movable between open and closed positions, said sleeve valve element having sealing engagement with said first concentric sealing means of said valve body means; and (b) pressure containment sleeve means extending from said sleeve valve element and having sealed engagement with said second sealing means of said valve body means, said pressure containment sleeve means defining said outlet opening means.

14. A circulating valve as recited in claim 10, wherein:

(a) a pressure containment sleeve is positioned within said valve body means and cooperates with said valve body means to define internal valve chamber means and to form said inner and outer concentric sealing means;

(b) said valve means being movably disposed within said valve chamber means and having sealing engagement with said valve body means and said pressure containment sleeve; and (c) said valve body means defines said outlet opening means.

15. A circulating valve as recited in claim 14, wherein said valve means comprises:

(a) an annular body of plastic sealing material forming a sealing surface at one extremity thereof for sealing engagement with said seat means; and (b) a metal reinforcing band disposed within said body of plastic sealing material and preventing pressure induced radial yielding thereof.

16. A circulating valve as recited in claim 10, wherein:

(a) a pressure containment sleeve is positioned externally of said valve body means and cooperates with said valve body means to define valve chamber means having inner and outer concentric cylindrical sealing surfaces forming said inner and outer concentric sealing means;

(b) said valve means is movably disposed within said valve chamber means and establishes sealing engagement with said inner and outer concentric sealing surfaces; and (c) said outlet opening is defined by said pressure containment sleeve.

17. A circulating valve as recited in claim 14, wherein:

said valve body means defines an inlet opening communicating said flow passage with said valve chamber, said inlet opening being located upstream of said seat means.

18. A circulating valve as recited in claim 10 wherein said body means comprises:

(a) an elongated integral tubular body forming said flow passage and forming an inner cylindrical sealing surface defining said inner cylindrical sealing means, said tubular body further being formed to define said inlet opening means;

(b) a pressure containment sleeve being secured in fixed relation to said tubular body and defining a cylindrical wall spaced from said tubular body and forming an outer cylindrical sealing surface disposed in concentric relation with said inner cylindrical sealing surface and forming said outer cylindrical selaing means; and (c) said valve means having inner and outer sealing means disposed in respective sealing engagement with said inner and outer cylindrical sealing surfaces.

19. A circulating valve for connection into the tubing string of a well for establishing selective flow of fluid between the tubing string and well casing, said circulating valve comprising:

(a) a tubular valve body defining a flow passage therethrough, said valve body forming inlet opening means and defining a first cylindrical sealing surface;

(b) seat means located outwardly of said tubular body and downstream of said inlet opening means;

(c) a sleeve valve element being disposed about said valve body and having a sealing portion thereof disposed for sealing engagement with said seat means, said sleeve valve element defining first and second pressure responsive areas and having sealing engagement with said first cylindrical sealing surface;

(d) urging means located about said valve body and urging said sleeve valve element toward said seat means;

(e) pressure containment means establishing sealed engagement between said body means and said sleeve valve element and cooperating with said body means to define pressure chamber means, said pressure containment means defining outlet opening means permitting flow of fluid from said pressure chamber means after opening of said valve element and defining a second cylindrical sealing surface being in outwardly spaced concentric relation with said first cylindrical sealing surface and having sealing engagement with said sleeve valve element; and (f) said second pressure responsive area of said sleeve valve element being exposed to pressure within said pressure chamber means, upon unseating of said valve element said first and second pressure responsive areas of said valve element being exposed to injection pressure, thereby permitting said sleeve valve element to be maintained open by injection pressure at lower pressure than is required for pressure responsive unseating of said sleeve valve element.

20. A circulating valve as recited in claim 19, wherein said pressure containment means comprises:

(a) a pressure containment wall extending from said sleeve valve element and being located in closely spaced relation about a portion of said valve body means; and (b) sealing means maintaining a seal between said pressure containment wall and said portion of said valve body means.

21. A circulating valve as recited in claim 19, wherein said pressure containment means comprises:

(a) a pressure containing wall extending from said valve body means and surrounding at least a portion of said sleeve valve element; and (b) sealing means maintaining said sealing engagement between said sleeve valve means and said pressure containing wall.

22. A circulating valve as recited in claim 19, wherein said sleeve valve element comprises:

(a) a metal sleeve element disposed about said body and defining a cylindrical wall cooperating with said body to define an annular seal receptacle, said cylindrical wall forming said pressure containment means and defining restricted opening means of smaller dimension than the dimension of said inlet opening means;

(b) means establishing a seal between said cylindrical wall and said tubular valve body; and (c) an annular body of plastic sealing material being disposed within said seal receptacle and being linearly movable along with said metal sleeve element, said cylindrical wall providing radial structural support about said annular body of plastic sealing material, said annular body of plastic sealing material defining sealing surface means for sealing engagement with said seat means.

23. A circulating valve as recited in claim 19, wherein:

said sleeve valve element defines sealing skirt means disposed about a portion of said tubular body, said sealing skirt means being sealed with respect to said tubular body and defining restricted discharge port means of smaller dimension as compared to the dimension of said inlet opening means.

24. A circulating valve as recited in claim 23, wherein:

(a) said tubular body defines annular seat means between said inlet opening means and said discharge port means; and (b) said sleeve valve element defines annular sealing means engaging said seat means in the closed position of said sleeve valve.

25. A circulating valve for connection into the tubing string of a well for establishing selective flow of fluid between the tubing string and well casing, said circulating valve comprising:

(a) a tubular valve body defining a flow passage therethrough, said valve body forming inlet opening means;

(b) seat means located outwardly of said tubular body and downstream of said inlet opening means;

(c) cylindrical wall means positioned in immovable spaced relation with said tubular valve body and defining a generally cylindrical valve receptacle about said tubular body, said cylindrical wall means establishing sealed engagement between said body means and said sleeve valve element and cooperating with said body means to define pressure chamber means, said pressure containment means defining outlet opening means permitting flow of fluid from said pressure chamber means after opening of said valve element;

(d) a sleeve valve element being disposed about said valve body and having sealing engagement with said tubular valve body and said cylindrical wall means and having a sealing portion thereof disposed for sealing engagement with said seat means, said sleeve valve element defining first and second pressure responsive areas;

(e) urging means located about said valve body and urging said sleeve valve element toward said seat means; and (f) said second pressure responsive area of said sleeve valve element being exposed to pressure within said pressure chamber means, upon unseating of said valve element said first and second pressure responsive areas of said valve element being exposed to injection pressure, thereby permitting said sleeve valve element to be maintained open by injection pressure at lower pressure than is required for pressure responsive unseating of said sleeve valve element.

26. A circulating valve as recited in claim 25, wherein:

(a) said sleeve valve element is composed of a generally cylindrical body of plastic sealing material and forms a sealing surface at one extremity thereof for sealing engagement with said seat means, said sleeve valve element moves linearly within said pressure containment means; and (b) a metal reinforcing band encircles at least a portion of said sleeve valve element and prevents pressure induced radial expansion thereof.

* * * * *